US008354925B1

(12) United States Patent
Libby et al.

(10) Patent No.: US 8,354,925 B1
(45) Date of Patent: Jan. 15, 2013

(54) MONITORING USING RF COMMUNICATION TECHNOLOGY

(75) Inventors: Vibeke Libby, Woodside, CA (US); John S. Camp, San Francisco, CA (US)

(73) Assignee: Lockheed Martin Corporation, Bethesda, MD (US)

( * ) Notice: Subject to any disclaimer, the term of this patent is extended or adjusted under 35 U.S.C. 154(b) by 846 days.

(21) Appl. No.: 12/499,036

(22) Filed: Jul. 7, 2009

Related U.S. Application Data

(60) Provisional application No. 61/080,637, filed on Jul. 14, 2008.

(51) Int. Cl.
*G08B 1/08* (2006.01)

(52) U.S. Cl. ..... 340/539.26; 340/539.1; 340/539.22; 340/539.23; 340/541; 340/561; 340/565; 340/566; 340/567; 340/511; 340/506

(58) Field of Classification Search ..... 340/539.1, 340/539.22, 539.23, 541, 561, 565, 566, 340/567, 511, 506
See application file for complete search history.

(56) References Cited

U.S. PATENT DOCUMENTS 7,733,220 B2 * 6/2010 Libby ..... 340/539.1
2008/0084295 A1 4/2008 Libby

* cited by examiner

*Primary Examiner* — Daryl Pope
(74) *Attorney, Agent, or Firm* — McDermott Will & Emery LLP

(57) ABSTRACT

Systems and methods for detecting change in an environment are provided. In one aspect, a system for detecting change in an environment includes an RF noise source configured to transmit an RF noise signal into the environment and to vary a parameter of the RF noise signal, and an interrogator configured to communicate with a plurality of communication devices distributed in the environment over a plurality of communication channels. The system also includes a detection system configured to receive information related to performances of the plurality of communication channels from the interrogator, to generate a fingerprint of the environment for each of the plurality of communication channels based on the performance of the communication channel at different values of the parameter of the RF noise signal, and to detect a change in the environment when one or more of the fingerprints deviates from a respective baseline fingerprint by a certain amount.

28 Claims, 5 Drawing Sheets

MONITORING USING RF COMMUNICATION TECHNOLOGY

RELATED APPLICATION

The present application claims the benefit of priority under 35 U.S.C. §119 from U.S. Provisional Patent Application Ser. No. 61/080,637, entitled "MONITORING USING RF COMMUNICATION TECHNOLOGY," filed on Jul. 14, 2008, which is hereby incorporated by reference in its entirety for all purposes.

STATEMENT REGARDING FEDERALLY SPONSORED RESEARCH OR DEVELOPMENT

Not Applicable.

FIELD OF THE INVENTION

This disclosure relates generally to monitoring systems and, more particularly to monitoring systems using RF communication technology.

BACKGROUND OF THE INVENTION

Security systems may be employed to detect an intruder in an environment under surveillance. Examples of security systems include systems using laser light, in which an intruder is detected by a break in a laser light caused by the intruder. Disadvantages of these security systems include high false alarm rates, danger to the eyes due to the laser light, and easily detectible coverage areas. In addition, these system can be easily defeated, for example, when the intruder moves around the laser light. Other systems use a heat sensor to detect the heat emitted by an intruder. These systems can be defeated, for example, by an intruder wearing thermally insulating material. In addition, these systems cannot detect when objects that do not emit detectable heat are removed or added to the environment.

Therefore, there is a need for systems and method capable of detecting changes in a monitored environment that overcome one or more of the disadvantages of current systems.

SUMMARY OF THE INVENTION

According to aspects of the disclosure, a monitoring system uses a communication system and an external controlled RF noise source that induces degradation of the communication system to generate a "fingerprint" of a monitored environment. The monitoring system can asses if any changes are occurring or have occurred in the monitored environment by checking the "fingerprint" for change. If an intrusion occurs, the system can assess whether the monitored environment was altered as a result of the intrusion.

In one aspect of the disclosure, a system for detecting a change in an environment is provided. The system includes an RF noise source configured to transmit an RF noise signal into the environment and to vary a parameter of the RF noise signal, and an interrogator configured to communicate with a plurality of communication devices distributed in the environment over a plurality of communication channels. The system also includes a detection system configured to receive information related to performances of the plurality of communication channels from the interrogator, to generate a fingerprint of the environment for each of the plurality of communication channels based on the performance of the communication channel at different values of the parameter of the RF noise signal, and to detect a change in the environment when one or more of the fingerprints deviates from a respective baseline fingerprint by a certain amount.

In another aspect of the disclosure, a method for monitoring an environment is provided. The method comprises transmitting an RF noise signal into the environment, varying a parameter of the RF noise signal, and communicating with a plurality of communication devices distributed in the environment over a plurality of communication channels. The method also comprises generating a fingerprint of the environment for each of a plurality of communication channels based on performance of the communication channel at different values of the parameter of the RF noise signal, and detecting a change in the environment when one or more of the fingerprints deviates from a respective baseline fingerprint by a certain amount.

BRIEF DESCRIPTION OF THE DRAWINGS

The accompanying drawings, which are included to provide further understanding of the invention and are incorporated in and constitute a part of this specification, illustrate aspects of the invention and together with the description serve to explain the principles of the invention.

DETAILED DESCRIPTION OF THE INVENTION

Figure 1:
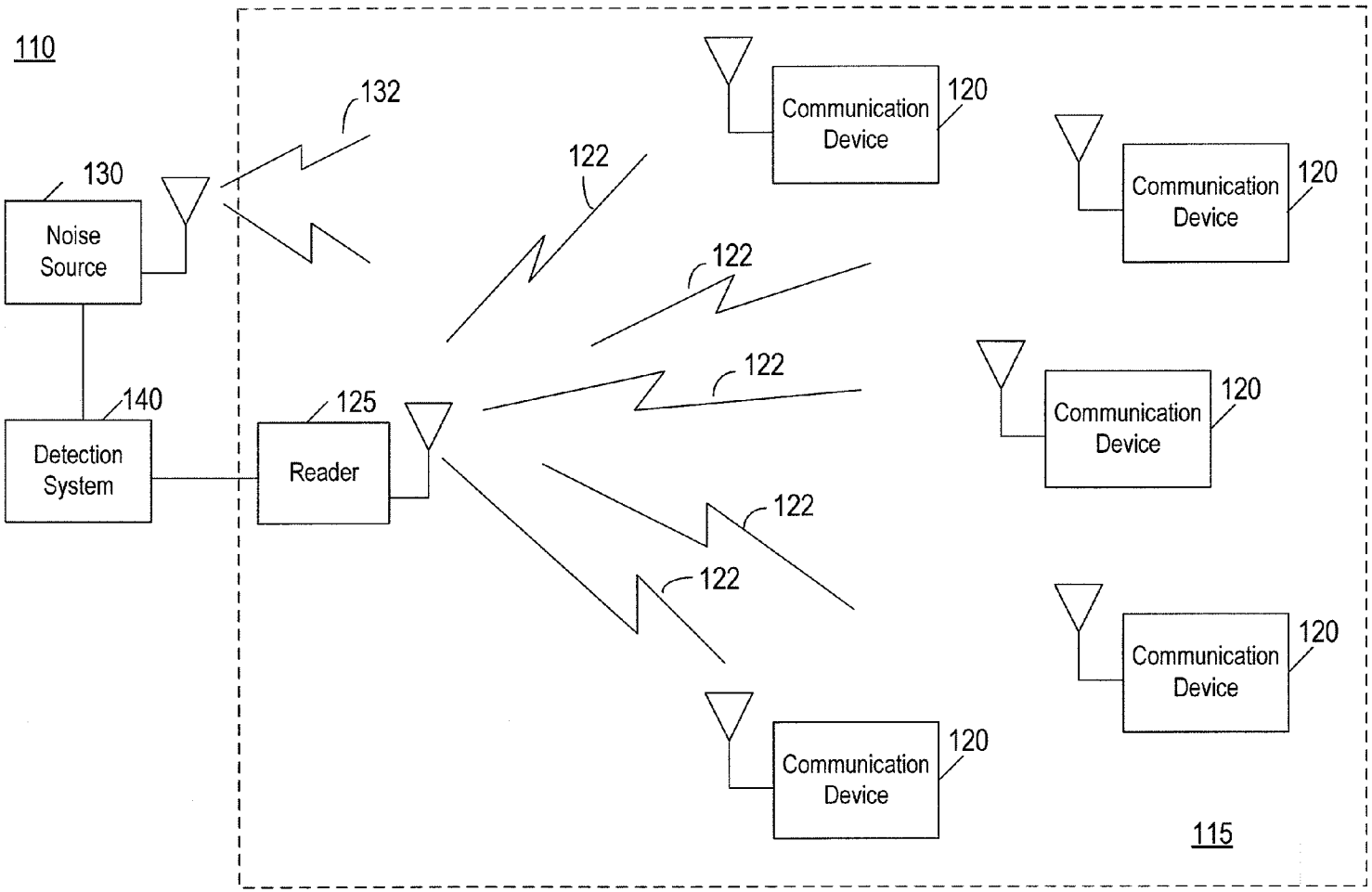
FIG. 1 is a conceptual block diagram of a monitoring system according to an aspect of the present disclosure.

In the following detailed description, numerous specific details are set forth to provide a full understanding of the subject technology. It will be obvious, however, to one ordinarily skilled in the art that the subject technology may be practiced without some of these specific details. In other instances, well-known structures and techniques have not been shown in detail to avoid obscuring concepts of the subject technology.

Reference will now be made in detail to aspects of the subject technology, examples of which are illustrated in the accompanying drawings, wherein like reference numerals refer to like elements throughout.

FIG. 1 is a conceptual block diagram of a monitoring system 110 according to an aspect of the present disclosure. The monitoring system 110 comprises a communication system 115. The communication system 115 comprises one or more communication devices 120 distributed in an environment being monitored and an interrogator 125 in communication with each communication device 120. Each communication device 120 may comprise a Radio Frequency ID (RFID) tag, a cellular communication device and/or other communication device. The interrogator 125 may communicate with each communication device 120 over a wireless communication channel 122. The monitoring system 110 further comprises a RF noise source 130 for transmitting controlled RF noise into the monitored environment and a detection system 140 coupled to the RF noise source 130 and the interrogator 125.

In one aspect of the disclosure, the detection system 140 monitors the environment by detecting changes in the performance of the communication system 115 due to changes in the environment. For example, when a communication device 120 communicates with the interrogator 125 over a wireless communication channel 122, the communication channel 122 may be subject to multipath interference. Multipath interference occurs when a wireless signal travels from the communication device 120 to the interrogator 125 in two or more different signal paths due to reflections off of objects in the environment. The two or more different signal paths cause portions of the wireless signal to arrive at the interrogator 125 at different times and interfere with each other. The communication channel 122 may also be subject to interference caused by an object blocking a signal path between the communication device 120 and the interrogator 125. Both types of interferences can impact the performance of the communication channel 122 between the communication device 120 and the interrogator 125. Further, both types of interferences can be affected by environmental conditions (e.g., presence or absence of objects in the environment and/or movement of objects in the environment). As a result, changes in the environment can cause detectable changes in the performance of one or more communication channels 122 in the communication system 115. Therefore, changes in the environment can be detected by detecting changes in the performance of the communication system 115. Changes in the performance of a communication channel 122 of the communication system 115 may be detected, for example, by monitoring a communication error rate, a bit error rate, a signal-to-noise ratio, frame error rate or other measure of channel performance.

In certain aspects, the interrogator 125 communicates with one or more communication devices 120 over respective communication channels 122 and the detection system 140 monitors the performance of the communication channel 122 for each communication device 120. In one aspect, the detection system 140 may monitor the performance of a communication channel 122 based on a communication error rate for the communication channel 122. In this aspect, a communication device 120 may periodically transmit a message to the interrogator 125 over a communication channel 122. Each time the communication device 120 transmits a message to the interrogator 125, the interrogator 125 may report to the detection system 140 whether it successfully received the message. The detection system 140 may then determine a communication error rate for the respective communication channel 122 based on the number of times the interrogator 125 did not successfully receive a message over the number of transmissions by the communication device 120. The performance of the communication channel 122 may also be measured based on a success rate which is a number of successful reads over the number of transmissions by the respective communication device 120. The performance of the communication channel may also be measured based on a bit error rate, a signal-to-noise ratio, a frame error rate or other measure of channel performance.

For each communication device 120, the detection system 140 may establish a performance baseline for the communication channel 122. The baseline for each communication channel 122 may be established, for example, by measuring the performance of the communication channel over a period of time and using an average of the measured performance over the period of time for the baseline. After the baseline for a communication channel 122 has been established, the performance of the communication channel 122 should stay relatively close to the baseline when the environment does not change. The performance of the communication channel 122 may deviate from the baseline due to changes in the environment (e.g., when an objected is added to, removed from, or moved in the environment). For example, an object that is moved between the communication device 120 and the interrogator 125 can interfere with the respective communication channel 122 resulting in a detectable degradation of the performance of the communication channel 122.

In one aspect, the detection system 140 monitors the performance of each communication channel 122 for deviations from the respective baseline. The detection system 140 may detect a change in the environment when the monitored performance of one or more communication channels 122 deviates from the respective baseline by a certain amount.

When the detection system 140 detects a change in the environment, the detection system 140 may activate an alarm (e.g., audio alarm, visual alarm, and/or other type of alarm). The detection system 140 may also alert proper authorities by sending a report to a computer used by the authorities (e.g., via a LAN network or the Internet). In another example, the detection system 140 may send an email, text message or voice message to the authorities reporting the detected change in the environment.

In an aspect of the disclosure, the monitoring system 110 controllably varies a parameter of the RF noise source 130 to obtain controlled variations in the performance of a communication channel 122. In one aspect, the RF noise source 130 may transmit an RF noise signal 132 into the environment and the controlled parameter may be a power level, frequency and/or other parameter of the RF noise source 130. The power level may correspond to a power level at which the RF noise source 130 transmits the RF noise signal 132 and the frequency may be a frequency of the RF noise signal 132. The RF noise source 130 may cycle through different values of the parameter. For example, when the controlled parameter is the power level, the RF noise source 130 may cycle through different values of the power level.

In one aspect, the detection system 140 generates a "fingerprint" of the environment for each communication channel 122 by measuring the performance of the communication channel 122 at different values of the controlled parameter of the RF noise source 130. For example, the detection system 140 may generate a "fingerprint" by measuring the performance of a communication channel 122 at different power levels and/or frequencies of the RF noise source 130. In this aspect, a "fingerprint" of the environment for each communication channel 122 may comprise measurements of the channel performance at different values of the controlled parameter of the RF noise source 130.

Figure 2:
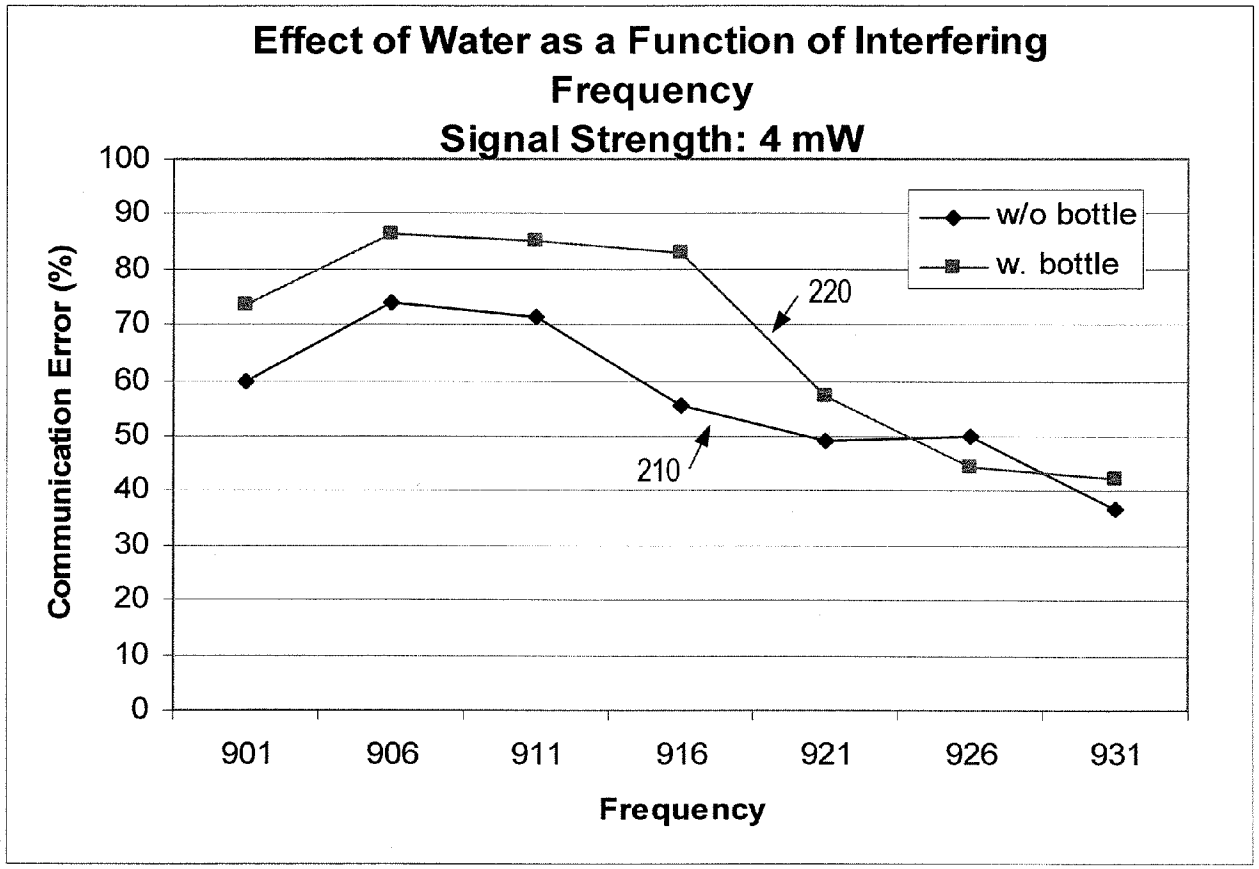
FIG. 2 is a plot showing "fingerprints" of a monitored environment with and without an object according an aspect of the present disclosure.

FIG. 2 is a plot showing an example of "fingerprints" 210 and 220 of an environment for a communication channel 122 under two different environmental conditions. In this example, each "fingerprint" 210 and 220 is generated by measuring the performance (e.g., communication error rate) of the communication channel 122 at different frequencies of the RF noise source 130. The frequencies in the plot are in Megahertz (MHz). The channel performance is measured at seven different RF noise frequencies to produce a "fingerprint" 210 and 220 of the environment. The channel performance may be measured at fewer than or more than seven different frequencies.

In the example in FIG. 2, the "fingerprint" 210 is obtained when a bottle filled with water is present in the environment and the "fingerprint" 220 is obtained when the bottle is removed from the environment. In this example, the presence or absence of the bottle in the environment clearly affects the "fingerprint" 210 and 220 of the environment for the communication channel 122, allowing the detection system 140 to detect the presence or absence of the bottle in the environment by checking the "fingerprint" 210 and 220 of the environment.

Although the "fingerprints" 210 and 220 in the example in FIG. 2 were generated by measuring the performance of a communication channel 122 at different frequencies of the RF noise source 130, a "fingerprint" may also be generated by measuring the performance of the communication channel 122 at different power levels of the RF noise source 130. A "fingerprint" may also be generated by varying two or more parameters of the RF noise source 130. A "fingerprint" of the environment according to various aspects of the disclosure provides a well characterized signature of the environment for detecting changes in the environment (e.g., when an objected is added to, removed from, or moved in the environment).

In one aspect, the detection system 140 varies a parameter (e.g., power level) of the RF noise source 130 and generates a "fingerprint" of the environment for each communication channel 122 by measuring the channel performance at different values of the parameter. For each communication channel 122, the detection system 140 may establish a baseline "fingerprint." The detection system 140 may establish a baseline "fingerprint" for a communication channel 122 by measuring the channel performance at different values of the RF noise parameter over a period of time and using an average of the measured channel performance at the different values of the RF noise parameter for the baseline "fingerprint." For each communication channel 122, the detection system 140 may also compute a standard deviation of the measured channel performance at the different values of the RF noise parameter over the period of time. The detection system 140 may then use the computed standard deviation to determine an amount by which a subsequent "fingerprint" for a communication channel 122 needs to deviate from the respective baseline "fingerprint" to trigger a detection of a change in the environment. For example, the amount may be set at twice the respective standard deviation. This helps ensure that normally occurring deviations of a "fingerprint" from the respective baseline "fingerprint" do not trigger a detection.

After establishing a baseline "fingerprint" for each communication channel 122, the detection system 140 may detect changes in the environment by monitoring the "fingerprint" for each communication channel 122 for deviations from the respective baseline "fingerprint." The detection system 140 may detect a change in the environment when the monitored "fingerprint" for one or more of the communication channels 122 deviates from the respective baseline by a certain amount. In one aspect, the detection system 140 may detect a change in the environment when the "fingerprints" of two or more communication channels 122 deviate from their respective baseline "fingerprints." This aspect reduces the likelihood of false alarms since the probability of two or more communication channels simultaneously producing false alarms is lower than one communication channel producing a false alarm.

When the detection system 140 detects a change in the environment, the detection system 140 may alert authorities using any of the methods discussed above or other methods. For example, the detection system 140 may also alert proper authorities by sending a report to a computer used by the authorities (e.g., via a LAN network or the Internet). In another example, the detection system 140 may send an email, text message or voice message to the authorities reporting the detected change in the environment.

In one aspect, the detection system 140 may control the parameter (power, frequency, amplitude, etc.) of the RF noise source 130. For example, the detection system 140 may cycle the RF noise source 130 through different values of the power level and/or frequency. In this aspect, the detection system 140 may measure the performance of a communication channel 122 while cycling through the different values of the power level and/or frequency of the RF noise source 130 to obtain a "fingerprint" of the environment.

In another aspect, the RF noise source 130 may cycle through the different values of the power level and/or frequency, and communicate the current value of the power level and/or frequency to the detection system 140. This allows the detection system 140 to measure the performance of a communication channel 122 at known values of the power level and/or frequency of the RF noise source 130 to obtain a "fingerprint." In another aspect, the RF noise source 130 may cycle through a predetermined set of values of the power level and/or frequency and dwell at each value for a fixed time interval known by the detection system 140. In this aspect, the detection system 140 may determine the power level and/or frequency of the RF noise source 130 at a given time by the start time of a power and/or frequency cycle.

The RF noise source 130 may be configured to degrade and/or enhance the performance of the communication channels 122. The RF noise source 130 may be located next to one of the communication devices 120 or at any other point in the environment that is advantageous for a particular application. The RF noise source 130 may also be integrated with the interrogator 125. The RF noise source 130 may also dynamically change parameters or go through a preset list of parameters (frequency, power level, amplitude, modulation etc.). When the parameter varies, so does the performances for the different communication channels 122. As the performance of a communication channel 122 changes over variations of the parameter, the environment is "fingerprinted." By comparing successive "fingerprints" for a communication channel 122, the detection system 140 can check the environment for change. For example, if successive "fingerprints" for the communication channel 122 change by a certain amount, then the detection system 140 may determine that a change in the environment has occurred.

According to various aspects of the disclosure, any RF noise or interference source 130 can be used to obtain "fingerprints." For example, the RF noise source 130 can be a broad-spectrum RF noise source (e.g., white-RF noise source) where the RF noise source cycles though different power settings. As another example, the RF noise source can be a signal generator that transmits an interfering signal that cycles through different frequencies. Further, various parameters of the RF noise source can be dynamically changed including, but not limited to, frequency, power, amplitude, modulation, etc.

Figure 3A:
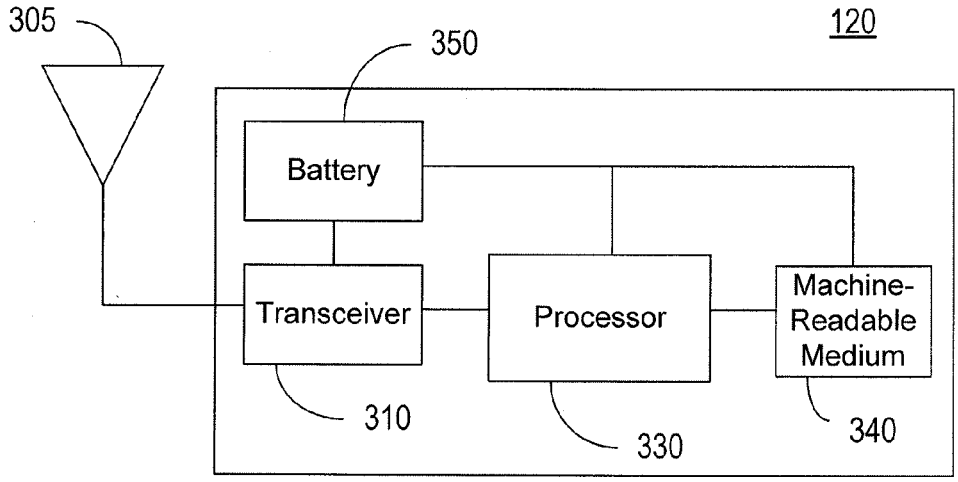
FIG. 3A is a conceptual block diagram of an active communication device according to an aspect of the present disclosure.

FIG. 3A is a conceptual block diagram of a communication device 120 according to an aspect of the disclosure. The communication device 120 in this aspect may be implemented with an active RFID tag, as discussed further below. The communication device 120 comprises an antenna 305, a transceiver 310, a processor 330, a machine readable medium 340 and a battery 350. The battery 350 supplies power to the transceiver 310, the processor 330, and the machine-readable medium 340.

In one aspect, the processor 330 may retrieve a message stored on the machine-readable medium 340 and transmit the message to the interrogator 125 over a wireless communication channel 122 using the transceiver 310 and antenna 305. The message may comprise a sequence of data bits that is unique to the communication device 120 so that the interrogator 125 can distinguish the message from messages transmitted by other communication devices 120. The processor 330 may periodically transmit the message to the interrogator 125 at predetermined intervals. The processor 330 may also receive an interrogation signal from the interrogator 125 using the transceiver 310 and antenna 305 and transmit the message in response to the interrogation signal. Also, the processor 330 may transmit the message using a frequency hopping scheme, in which transceiver 310 hops to different transmit frequencies.

The communication device 120 according to this aspect may be implemented with an active RFID tag having an internal power source (e.g., battery 350). An advantage of an active RFID tag is that the internal power source allows the active RFID tag to transmit over longer distances. As a result, the active RFID tag can be spaced farther away from the interrogator 125, allowing the monitoring system 100 to monitor an environment over a larger area. Further, RFID tags can be low cost, allowing a monitoring system 100 to employ many RFID tags distributed throughout an environment being monitored at different locations. Other advantages of using RFID tags are discussed below.

Figure 3B:
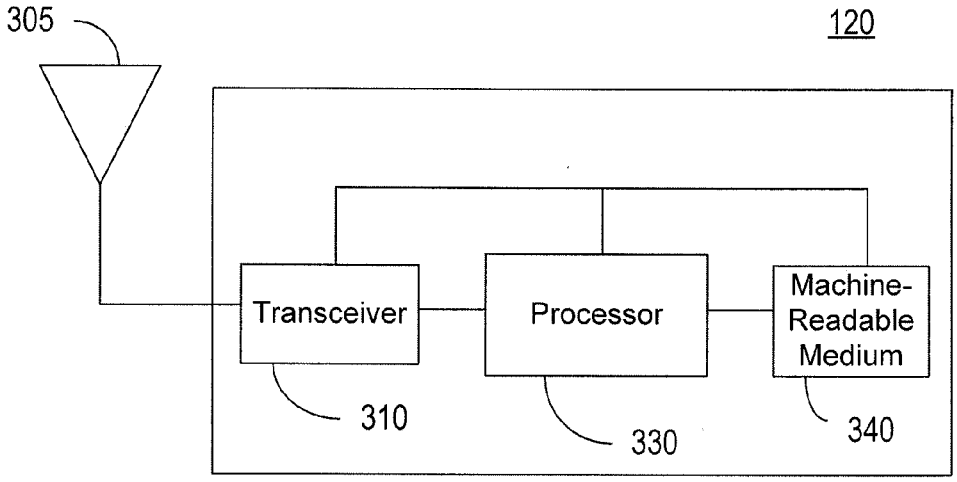
FIG. 3B is a conceptual block diagram of a passive communication device according to an aspect of the present disclosure.

FIG. 3B is a conceptual block diagram of a communication device 120 according to another aspect of the disclosure, in which the communication device 120 receives power from an external source. The communication device 120 in this aspect may be implemented with a passive RFID tag, as discussed further below.

In one aspect, the interrogator 125 may transmit an interrogation signal to the communication device 120. The transceiver 310 of the communication device 120 may receive the interrogation signal and absorb power from the interrogation signal and use the absorbed power to power the transceiver 310, the processor 330 and the machine-readable medium 340. For example, the transceiver 310 may comprise an RF coil that inductively absorbs power from the interrogation signal. In response to the interrogation signal, the processor 330 may transmit a message to the interrogator 125 using the transceiver 310 and antenna 305.

The communication device 120 according to this aspect may be implemented with a passive RFID tag that is powered from the interrogation signal from the interrogator 125. Advantages of a passive RFID tag include low cost and no need to replace a battery.

Figure 4:
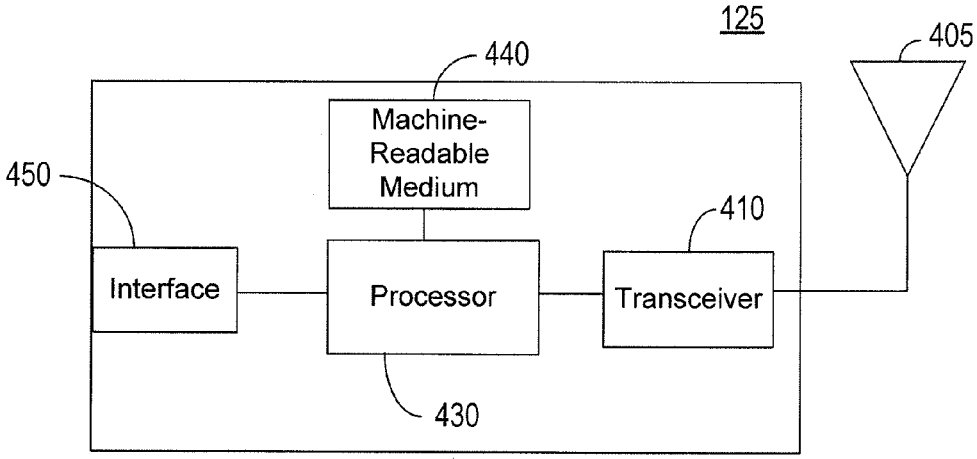
FIG. 4 is a conceptual block diagram of an interrogator according to an aspect of the present disclosure.

FIG. 4 is a conceptual block diagram of the interrogator 125 according to an aspect of the disclosure. The interrogator 125 comprises a antenna 405, a transceiver 410, a processor 430, a machine readable medium 440 and an interface 450. The interface 450 provides communication between the interrogator 125 and the detection system 140 over a wired connection (e.g., USB cable) and/or wireless connection (e.g., Bluetooth, WiFi, infrared connection). The machine-readable medium 440 may store a software program that is executed by the processor 430 for performing various functions of the interrogator 125 discussed in the disclosure.

In one aspect, the processor 430 may receive messages from the communication devices 120 over the respect communication channels 122 using the transceiver 410 and antenna 405. The message from each communication device 120 may include a unique identifier (e.g., sequence of bits) identifying the communication device 120. Each time a communication device 120 transmits a message to the interrogator 125, the processor 430 may determine whether it successfully received the message over the respective communication channel 122. The processor 430 may then report to the detection system 140 whether it successfully received the message via the interface 450.

In one aspect, a communication device 120 may transmit a message to the interrogator 125 at predetermined time intervals. In this aspect, the processor 430 may determine when the communication device 120 has transmitted a message to the interrogator 125 based on the predetermined time intervals. In another aspect, the processor 430 may transmit an interrogation signal to one or more of the communication devices 120 using the transceiver 410 and antenna 405. The interrogation signal may command the one or more communication devices 120 to transmit a message to the interrogator 125. The interrogation signal may also provide power to the one or more communication devices 120 when passive communication devices 120 are used. In this aspect, the processor 430 may determine that it did not successfully receive a message from a communication device 120 when the processor 430 does not successfully receive a message from the communication device 120 in response to the interrogation signal.

Figure 5:
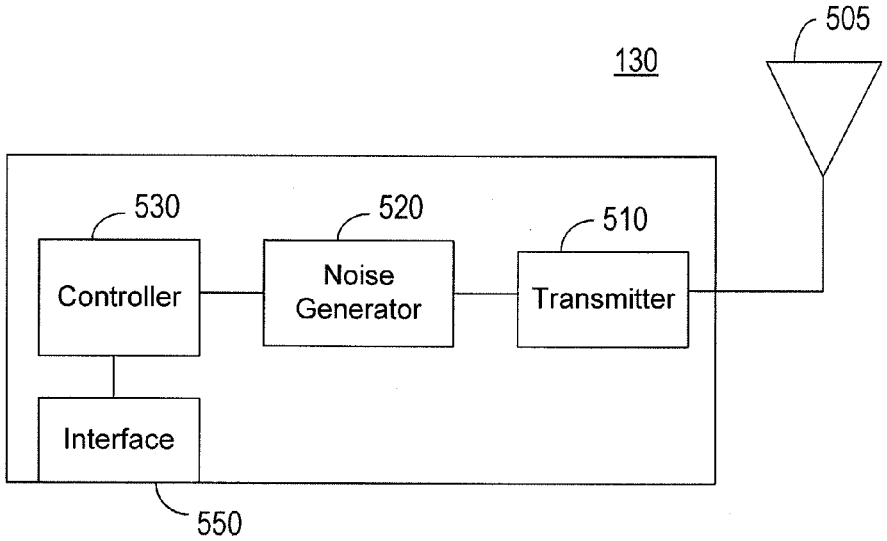
FIG. 5 is a conceptual block diagram of an RF noise source according to an aspect of the disclosure.

FIG. 5 is a conceptual block diagram of the RF noise source 130 according to an aspect of the disclosure. The RF noise source 130 comprises an antenna 505, a transmitter 510, an RF noise generator 520, a controller 530 and an interface 550. The interface 550 provides communication between the RF noise source 130 and the detection system 140 over a wired connection (e.g., USB cable) and/or wireless connection (e.g., Bluetooth, WiFi, infrared connection).

In one aspect, the RF noise generator 520 generates an RF noise signal and the transmitter 510 transmits the RF noise signal 132 into the monitored environment via the antenna 505. The RF noise generator 520 may generate a broad-spectrum RF noise signal (e.g., white-RF noise signal), an interfering signal having an adjustable frequency, or other types of RF noise signals.

In one aspect, the controller 530 varies a parameter of the RF noise source 130. For example, the controller 530 may vary a power level of the RF noise source 130 by varying the power of the RF noise generator 520 and/or transmitter 510. In another example, the controller 530 may vary a frequency of the RF noise source 130 by varying a frequency in the RF noise generator 520. In one aspect, the controller 520 may vary the parameter of the RF noise source 130 based on commands received from the detection system 140 via the interface 550. In another aspect, the controller 520 may cycle through predetermined values of the parameter and communicate the current value of the parameter to the detection system 140 via the interface 550.

Figure 6:
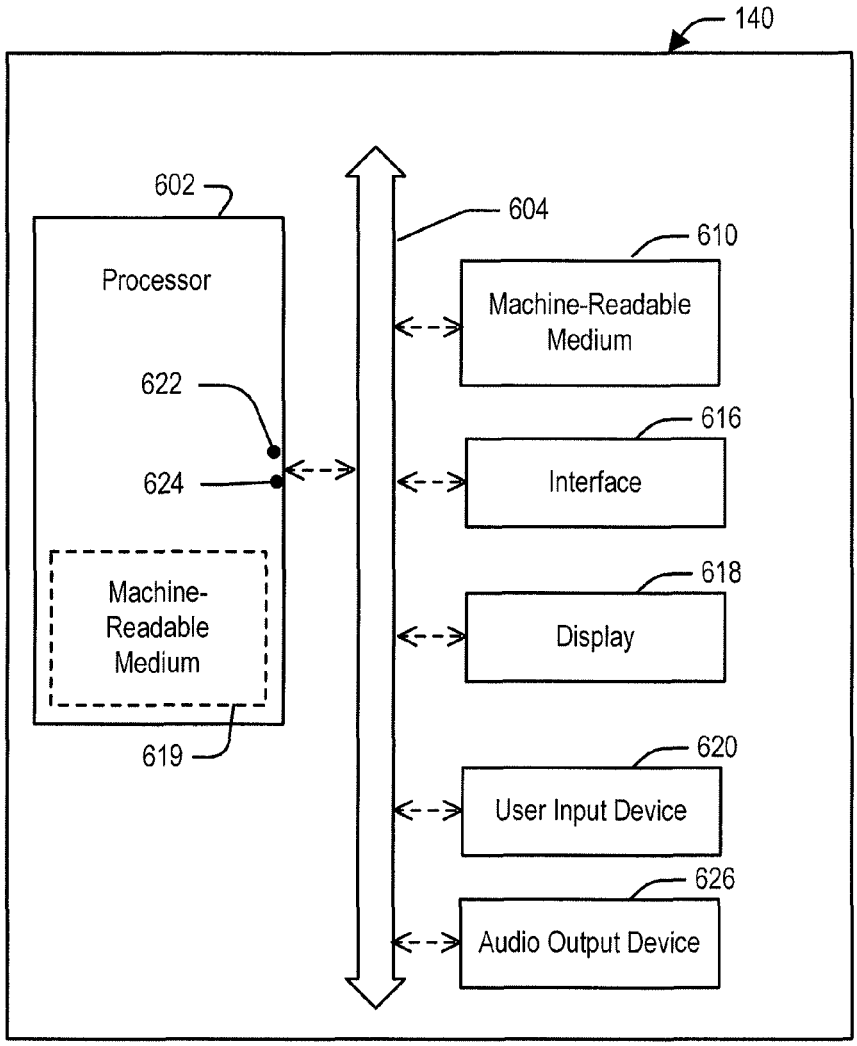
FIG. 6 is a conceptual block diagram of a detection system according to an aspect of the present disclosure.

FIG. 6 is a conceptual block diagram of the detection system 140 according to an aspect of the disclosure. The detection system 140 may be implemented with a PC computer or other computer. The detection system 140 comprises a processor 602, a machine-readable medium 610 and an interface 616. The machine-readable medium 610 may store software programs that are executed by the processor 602 for performing the various functions of the detection system 140 discussed in the disclosure. The interface 616 provides communication between the detection system 140 and the interrogator 125 and between the detection system 140 and the RF noise source 130 over wired connections (e.g., USB cable) and/or wireless connections (e.g., Bluetooth, WiFi, infrared connection). The interface 616 may also provide communication between the detection system 140 and a network (e.g., LAN, the Internet, and/or cellular network) to allow the detection system 140 to send a report of a detected change in the monitored environment to a computer or other device used by authorities via the network, as discussed above.

The detection system 140 may also comprise a display 618, a user input device 620 (e.g., keyboard, mouse, etc.) and an audio output device 626 (e.g., speakers). The processor 602 may display a detected change in the environment on the display 618 to alert a user at the detection system 140 of the change in the environment. The processor 602 may also output an audio alarm of a detected change in the environment using the audio output device 626.

The processor 602, the machine-readable medium 610, interface 616, display 618, user input device 620 and audio output device 626 may communicate via a bus 604 or other structures or devices. It should be understood that communication means other than busses can be utilized with the disclosed configurations.

The processor 602 in the disclosure may include a general-purpose processor or a specific-purpose processor for executing instructions and may further include a machine-readable medium 619, such as a volatile or non-volatile memory, for storing data and/or instructions for software programs. The instructions, which may be stored in a machine-readable medium 619 and/or 610, may be executed by the processor 602 to perform the various functions of the detection system 140 discussed in the disclosure. The processor 602 may include an input port 622 and an output port 624. Each of the input port 622 and the output port 624 may include one or more ports. The input port 622 and the output port 624 may be the same port (e.g., a bi-directional port) or may be different ports.

The processor 602 may be implemented using software, hardware, or a combination of both. By way of example, the processor 602 may be implemented with one or more processors. A processor may be a general-purpose microprocessor, a microcontroller, a Digital Signal Processor (DSP), an Application Specific Integrated Circuit (ASIC), a Field Programmable Gate Array (FPGA), a Programmable Logic Device (PLD), a controller, a state machine, gated logic, discrete hardware components, or any other suitable device that can perform calculations or other manipulations of information.

A machine-readable medium may be one or more machine-readable media. Software shall be construed broadly to mean instructions, data, or any combination thereof, whether referred to as software, firmware, middleware, microcode, hardware description language, or otherwise. Instructions may include code (e.g., in source code format, binary code format, executable code format, or any other suitable format of code).

Machine-readable media (e.g., 610) may include storage integrated into a processing system, such as might be the case with an ASIC. Machine-readable media (e.g., 610) may also include storage external to a processing system, such as a Random Access Memory (RAM), a flash memory, a Read Only Memory (ROM), a Programmable Read-Only Memory (PROM), an Erasable PROM (EPROM), registers, a hard disk, a removable disk, a CD-ROM, a DVD, or any other suitable storage device. In addition, machine-readable media may include a transmission line or a carrier wave that encodes a data signal. Those skilled in the art will recognize how best to implement the described functionality for the detection system 140. According to one aspect of the disclosure, a machine-readable medium is a computer-readable medium encoded or stored with instructions and is a computing element, which defines structural and functional interrelationships between the instructions and the rest of the system, and which permit the instructions' functionality to be realized. Instructions can be, for example, a computer program including code.

The processors 330 and 430 of a communication device 120 and the interrogator 125, respectively, may be implemented with any of the exemplary processors discussed above. Similarly, the machine-readable media 340 and 440 of a communication device 120 and the interrogator 125, respectively, may be implemented with any of the exemplary machine-readable media discussed above.

Thus, the monitoring system 110 according to various aspects of the disclosure is able to detect changes in a monitored environment. In one aspect, the detection system 140 establishes a baseline "fingerprint" of the monitored environment for each communication channel 122, and monitors the "fingerprint" for each communication channel 122 for change from the respective baseline "fingerprint." The detection system 140 may detect a change in the environment when one or more of the monitored "fingerprints" deviates from the respective baseline "fingerprint" by a certain amount.

The monitoring system 110 according to various aspects of the disclosure can detect changes in an environment due to the addition of an object to the environment, the removal of an object from the environment and/or movement of an object within the environment. This is because these environmental changes can affect the performance of a communication channel 122 and therefore change the respective "fingerprint" of the environment, which is based on the performance of the communication channel 122 at different values of the RF noise parameter.

Thus, the monitoring system 110 can detect the presence of an intruder in a monitored environment since the presence of the intruder constitutes an object added to the environment. The monitoring system 110 can also detect when the intruder is moving within the environment since movements of the intruder can cause one or more "fingerprints" of the environment to change. In this aspect, the communication devices 120 may frequently transmit messages to the interrogator 125, allowing the detection system 140 to frequently update the "fingerprints" of the environment and therefore monitor the environment in real time.

Thus, the monitoring system 110 can be used in applications such as surveillance, motion detection, intruder detection and other applications. For example, the monitoring system 110 may be used in conjunction with a security camera to monitor an environment. In this example, the monitoring system 110 may be used to detect the presence of an intruder in the environment and the security camera may be used to view the detected intruder. Thus, the monitoring system 110 may be used to alert security personal to view the environment using the security camera when an intruder enters the environment. In another example, the monitoring system 110 may be used for border control to detect illegal immigrants crossing a monitored environment located at an international border.

The monitoring system 110 can also detect an alteration in the environment caused by an intruder after the intruder has left the environment. The monitoring system 110 can detect an alteration due to the removal of an object from the environment and/or the addition of an object to the environment. The example in FIG. 2 demonstrated that the monitoring system 110 can detect the presence or absence of an object (e.g., bottle) in an environment by monitoring a "fingerprint" of the environment for changes. Thus, the monitoring system 110 can be used to detect theft of an object from the environment by detecting the removal of the object from the environment. The monitoring system 110 can also detect an object (e.g., bomb) left behind by an intruder in the environment by detecting the addition of the object to the environment.

The sensitivity of the monitoring system 110 can be increased by increasing the number of communication devices 120 employed in the monitoring system 110. When many communication channels are present, the statistics of the individual channel performance can be extremely well quantified. In fact, the most minute changes can be detected in stable and controlled situations. Even changes occurring outside the reach of the communication channel can be detected.

As discussed above, the communication devices 120 may be implemented with RFID tags. Advantages of RFID tags include low cost, which allows the monitoring system 110 to employ many (e.g., hundreds of) RFID tags that are distributed throughout a monitored environment. This allows the detection system 140 to generate and monitor many different "fingerprints" of the environment, which increases the sensitivity of the monitoring system 110 to changes in the environment. Advantages of RFID tags also include small size, which allows the RFID tags to be more easily concealed in the monitored environment.

Further, each RFID tag may be sealed in a durable case (e.g., plastic case), which allows the RFID tag to be exposed to conditions (e.g., rain) in an outdoor environment. As a result, RFID tags may be easily distributed at different locations in an outdoor environment to monitor the outdoor environment (e.g., international border, outdoor entrance gate, etc.). For example, the RFID tags may be dispersed over a large area from an aircraft or other vehicle. An RFID tag may also be buried in the ground at a depth that allows RF signals to penetrate through the ground to and from the RFID tag. This allows the RFID tag to be easily concealed in an outdoor environment.

In one aspect, the monitoring system 110 may be used to identify a chemical type of an unknown sample. In this aspect, known samples of different chemical compounds may be placed in the monitored environment at different times and the detection system 140 may record one or more "fingerprints" of the environment for each known sample. The "fingerprint" for each known sample may be stored in the machine-readable medium 610. In this aspect, the different "fingerprints" for the known samples may be obtained with the known samples placed in the same container at the same location in the monitored environment at different times. This helps ensure that differences in the "fingerprints" among the different known samples is due to the different properties of the known samples. After "fingerprints" for the different known samples have been recorded, the monitoring system 110 may be used to identify the chemical type of an unknown sample by obtaining a "fingerprint" of the environment with the unknown sample. The unknown sample may be placed in the same container at the same location in the environment used to record the "fingerprints" of the known samples. The detection system 140 may then compare the "fingerprint" for the unknown samples with the "fingerprints" of the known samples. The detection system 140 may then determine the chemical type of the unknown sample based on the "fingerprint" of the known samples having the closest match to the "fingerprint" of the unknown sample.

In another aspect, the communication devices 120 may communicated with one another over wireless communication channels. In this aspect, each communication device 120 may communicate with one or more of the other communication devices 120 over one or more respective communication channels. Each communication device 120 may then measure the performance of each communication channel with another communication device 120 and transmit the resulting channel performance measurements to the detection system 140 over a wireless channel. The channel performance measurements may be based on communication error rates, bit error rates, signal-to-noise ratios, frame error rates or other measures of channel performance. In this example, the communication devices 120 may be implemented with cellular phones or other communication devices capable of communicating with one another.

In this aspect, the detection system 140 may include a wireless receiver for receiving channel performance measurements from the communication devices 120. The detection 140 may then use the received channel performance measurements and the known values of the controller parameter of the RF noise source 130 to generate "fingerprints" of the environment. In this aspect, the interrogator 125 may be omitted since the detection system 140 receives the channel performance measurements from the communication devices 120.

One approach to monitoring an environment involves modifying a frequency hopping communication system by varying its output power through failure. A drawback of this approach, however, is that the power variations required to make current commercial off-the-shelf (COTS) communication systems (e.g., cellular phones, RFID systems, etc.) fail require access to the systems' power control, which is difficult for an external user to access. In cellular phones, for example, the power is automatically changed with the purpose of making the communication system work with as few dropped calls as possible, which is the exact opposite of what is required in the above-mentioned approach.

The monitoring system 110 according to various aspects of the disclosure are advantageous over other systems because it eliminates the need for a sophisticated frequency hopping communication system and stepwise power control in the communication system. In particular, the stepwise power control causes a significant problem because general communication systems do not give the user access to their power control. This makes it difficult for a developer to access the system control functions. This also has the potential drawback that warranties can no longer be obtained from the vendor. In addition, once the access is granted, a new software routine has to be written, tested, and maintained. All of these functions drive up cost, complexity and operational maintenance. By contrast, monitoring system 1110 according to various aspects of the disclosure, varies one or more parameters of an external controllable RF noise source 130, eliminating the need to vary power within the communication system 115. The external RF noise source 130 can be specifically tailored to the geometry and needs of monitored environment. Thus, aspects of the disclosure can be used with any communication system by perturbing the communication system with an RF noise source 130 to obtain "fingerprints" of the monitored environment.

Another advantage of aspects of the disclosure is the ability to control the location of the RF noise source 130 thereby making it more covert and thereby less susceptible to detection. Another advantage is that the power levels can be kept lower. The RF noise source 130 need not be turned on at all times but may be triggered by a specific event (e.g., intrusion). Aspects of the disclosure eliminate the requirement for communication frequency hopping, eliminate the need for internal power control, and can apply simpler processing techniques.

Those of skill in the art would appreciate that the various illustrative blocks, modules, elements, components, methods, and algorithms described herein may be implemented as electronic hardware, computer software, or combinations of both.

To illustrate this interchangeability of hardware and software, various illustrative blocks, modules, elements, components, methods, and algorithms have been described above generally in terms of their functionality. Whether such functionality is implemented as hardware or software depends upon the particular application and design constraints imposed on the overall system. Skilled artisans may implement the described functionality in varying ways for each particular application. Various components and blocks may be arranged differently (e.g., arranged in a different order, or partitioned in a different way) all without departing from the scope of the subject technology.

It is understood that the specific order or hierarchy of steps in the processes disclosed is an illustration of exemplary approaches. Based upon design preferences, it is understood that the specific order or hierarchy of steps in the processes may be rearranged. Some of the steps may be performed simultaneously. The accompanying method claims present elements of the various steps in a sample order, and are not meant to be limited to the specific order or hierarchy presented.

The previous description is provided to enable any person skilled in the art to practice the various aspects described herein. The previous description provides various examples of the subject technology, and the subject technology is not limited to these examples. Various modifications to these aspects will be readily apparent to those skilled in the art, and the generic principles defined herein may be applied to other aspects. Thus, the claims are not intended to be limited to the aspects shown herein, but is to be accorded the full scope consistent with the language claims, wherein reference to an element in the singular is not intended to mean "one and only one" unless specifically so stated, but rather "one or more." Unless specifically stated otherwise, the term "some" refers to one or more. Pronouns in the masculine (e.g., his) include the feminine and neuter gender (e.g., her and its) and vice versa. Headings and subheadings, if any, are used for convenience only and do not limit the invention.

A phrase such as an "aspect" does not imply that such aspect is essential to the subject technology or that such aspect applies to all configurations of the subject technology. A disclosure relating to an aspect may apply to all configurations, or one or more configurations. An aspect may provide one or more examples. A phrase such as an aspect may refer to one or more aspects and vice versa. A phrase such as an "embodiment" does not imply that such embodiment is essential to the subject technology or that such embodiment applies to all configurations of the subject technology. A disclosure relating to an embodiment may apply to all embodiments, or one or more embodiments. An embodiment may provide one or more examples. A phrase such an embodiment may refer to one or more embodiments and vice versa. A phrase such as a "configuration" does not imply that such configuration is essential to the subject technology or that such configuration applies to all configurations of the subject technology. A disclosure relating to a configuration may apply to all configurations, or one or more configurations. A configuration may provide one or more examples. A phrase such a configuration may refer to one or more configurations and vice versa.

The word "exemplary" is used herein to mean "serving as an example or illustration." Any aspect or design described herein as "exemplary" is not necessarily to be construed as preferred or advantageous over other aspects or designs.

All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. §112, sixth paragraph, unless the element is expressly recited using the phrase "means for" or, in the case of a method claim, the element is recited using the phrase "step for." Furthermore, to the extent that the term "include," "have," or the like is used in the description or the claims, such term is intended to be inclusive in a manner similar to the term "comprise" as "comprise" is interpreted when employed as a transitional word in a claim.

What is claimed is:

1. A system for detecting a change in an environment, comprising:

an RF noise source configured to transmit an RF noise signal into the environment and to vary a parameter of the RF noise signal;

an interrogator configured to communicate with a plurality of communication devices distributed in the environment over a plurality of communication channels; and a detection system configured to receive information related to performances of the plurality of communication channels from the interrogator, to generate a fingerprint of the environment for each of the plurality of communication channels based on the performance of the communication channel at different values of the parameter of the RF noise signal, and to detect a change in the environment when one or more of the fingerprints deviates from a respective baseline fingerprint by a certain amount.

2. The system of claim 1, wherein the parameter of the RF noise signal comprises a power level of the RF noise signal.

3. The system of claim 1, wherein the parameter of the RF noise signal comprises a frequency spectrum of the RF noise signal.

4. The system of claim 1, wherein the parameter of the RF noise signal comprises a modulation of the RF noise signal.

5. The system of claim 1, wherein the performance of each communication channel is based on a communication error rate, a read success rate, a bit error rate or a signal-to-noise ratio of the communication channel.

6. The system of claim 1, wherein each communication device is configured to vary a frequency or amplitude modulation of the respective communication channel.

7. A method for monitoring an environment comprising:

transmitting an RF noise signal into the environment;

varying a parameter of the RF noise signal;

communicating with a plurality of communication devices distributed in the environment over a plurality of communication channels;

generating a fingerprint of the environment for each of a plurality of communication channels based on performance of the communication channel at different values of the parameter of the RF noise signal; and detecting a change in the environment when one or more of the fingerprints deviates from a respective baseline fingerprint by a certain amount.

8. The method of claim 7, wherein the parameter of the RF noise signal comprises a power level of the RF noise signal.

9. The method of claim 7, wherein the parameter of the RF noise signal comprises a frequency of the RF noise signal.

10. The method of claim 7, wherein the parameter of the RF noise signal comprises a modulation of the RF noise signal.

11. The method of claim 7, wherein the performance of each communication channel is based on a communication error rate, a read success rate, a bit error rate or a signal-to-noise ratio of the communication channel.

12. The method of claim 7, wherein each communication device is configured to vary a frequency or amplitude modulation of the respective communication channel.

13. The method of claim 7, wherein communicating with a plurality of communication devices distributed in the environment comprises receiving a unique message from each communication device over a respective one of the communication channels at predetermined time intervals.

14. The method of claim 7, wherein communicating with a plurality of communication devices distributed in the environment comprises transmitting an interrogation signal to the communication devices and receiving a unique message from each communication device over a respective one of the communication channels in response to the interrogation signal.

15. A system for detecting a change in an environment, comprising:

an RF noise source configured to transmit an RF noise signal into the environment and to vary a parameter of the RF noise signal;

a plurality of communication devices distributed in the environment;

an interrogator configured to communicate with the plurality of communication devices over a plurality of communication channels; and a detection system configured to receive information related to performances of the plurality of communication channels from the interrogator, to generate a fingerprint of the environment for each of the plurality of communication channels based on the performance of the communication channel at different values of the parameter of the RF noise signal, and to detect a change in the environment when one or more of the fingerprints deviates from a respective baseline fingerprint by a certain amount.

16. The system of claim 15, wherein the parameter of the RF noise signal comprises a power level of the RF noise signal.

17. The system of claim 15, wherein the parameter of the RF noise signal comprises a frequency of the RF noise signal.

18. The system of claim 15, wherein the parameter of the RF noise signal comprises a modulation of the RF noise signal.

19. The system of claim 15, wherein the performance of each communication channel is based on a communication error rate, a read success rate, a bit error rate or a signal-to-noise ratio of the communication channel.

20. The system of claim 1, wherein each communication device is configured to vary a frequency or amplitude modulation of the respective communication channel.

21. The system of 15, wherein each of the plurality of communication devices comprises a Radio Frequency IF (RFID) tag, and each RFID tag is configured to transmit a unique message to the interrogator over a respective one of the communication channels at predetermined time intervals.

22. The system of 15, wherein each of the plurality of communication devices comprises a Radio Frequency IF (RFID) tag, and wherein the interrogator is configured to transmit an interrogation signal and each RFID tag is configured to transmit a unique message to the interrogator over a respective one of the communication channels in response to the interrogation signal.

23. A system for detecting a change in an environment, comprising:

an RF noise source configured to transmit an RF noise signal into the environment and to vary a parameter of the RF noise signal;

a plurality of communication devices distributed in the environment, wherein each communication device is configured to communicate with one or more of the other communication devices over one or more respective communication channels; and a detection system configured to receive information related to performances of the communication channels from the communication devices, to generate a fingerprint of the environment for each of the communication channels based on the performance of the communication channel at different values of the parameter of the RF noise signal, and to detect a change in the environment when one or more of the fingerprints deviates from a respective baseline fingerprint by a certain amount.

24. The system of claim 23, wherein the parameter of the RF noise signal comprises a power level of the RF noise signal.

25. The system of claim 23, wherein the parameter of the RF noise signal comprises a frequency spectrum of the RF noise signal.

26. The system of claim 23, wherein the parameter of the RF noise signal comprises a modulation of the RF noise signal.

27. The system of claim 23, wherein the performance of each communication channel is based on a communication error rate, a read success rate, a bit error rate or a signal-to-noise ratio of the communication channel.

28. The system of claim 23, wherein each communication device is configured to vary a frequency or amplitude modulation of the respective communication channel.

* * * * *